US009655398B2

(12) United States Patent
Zanchi

(10) Patent No.: US 9,655,398 B2
(45) Date of Patent: May 23, 2017

(54) HELMET WITH REMOVABLE CHIN GUARD

(71) Applicant: CI.ERRE.E. S.R.L., Osso Sotto (BG) (IT)

(72) Inventor: Ferruccio Zanchi, Capizzone (IT)

(73) Assignee: Ci.ERRE.E S.r.l., Brembate di Sopra (BG) (IT)

( * ) Notice: Subject to any disclaimer, the term of this patent is extended or adjusted under 35 U.S.C. 154(b) by 191 days.

(21) Appl. No.: 14/366,895

(22) PCT Filed: Dec. 21, 2012

(86) PCT No.: PCT/EP2012/076649

§ 371 (c)(1),
(2) Date: Jun. 19, 2014

(87) PCT Pub. No.: WO2013/093008

PCT Pub. Date: Jun. 27, 2013

(65) Prior Publication Data

US 2014/0338106 A1 Nov. 20, 2014

(30) Foreign Application Priority Data

Dec. 22, 2011 (IT) ..... BG20110046 U

(51) Int. Cl.

| | |
|---|---|
| ***A42B 3/08*** | (2006.01) |
| ***A42B 3/18*** | (2006.01) |
| ***A42B 3/20*** | (2006.01) |
| ***A42B 3/32*** | (2006.01) |

(52) U.S. Cl.
CPC ..... *A42B 3/08* (2013.01); *A42B 3/205* (2013.01); *A42B 3/326* (2013.01)

(58) Field of Classification Search
CPC .. A42B 3/326; A42B 3/32; A42B 3/08; A42B 1/006; A42B 3/006; A42B 3/04; A42B 3/18; A42B 3/20; A42B 3/205; A42B 3/222; A42B 3/223
USPC ..... 2/424
See application file for complete search history.

(56) References Cited

U.S. PATENT DOCUMENTS 4,024,587 A * 5/1977 Barford ..... A42B 3/326 2/424
4,641,382 A * 2/1987 Gessalin ..... A42B 3/326 2/414
4,689,836 A * 9/1987 Vitaloni ..... A42B 3/326 2/411

(Continued)

FOREIGN PATENT DOCUMENTS

DE 3214020 A1 * 7/1983
DE WO 2016000687 A1 * 1/2016 ..... A42B 3/326

(Continued)

OTHER PUBLICATIONS

International Search Report and Written Opinion issued Oct. 31, 2014 in Application No. PCT/EP2012/076649.

*Primary Examiner* — Amy Vanatta
(74) *Attorney, Agent, or Firm* — Polsinelli PC

(57) ABSTRACT

The present invention relates to a protective helmet (1) comprising a chin guard (11) removable from an operating position, for protecting the chin, characterized in that the shell (21) of the helmet (1) is provided with a portion (31) for coupling with the chin guard (11) when removed.

22 Claims, 2 Drawing Sheets

(56) References Cited

U.S. PATENT DOCUMENTS 4,766,615 A * 8/1988 Morin ..... A42B 3/326 2/410
4,769,857 A * 9/1988 Cianfanelli ..... A42B 3/326 2/421
5,517,698 A * 5/1996 Nault ..... A42B 3/066 2/424
5,619,755 A 4/1997 Casartelli
2003/0182716 A1* 10/2003 Wu ..... A42B 3/326 2/424
2005/0015861 A1* 1/2005 Gafforio ..... A42B 3/326 2/424
2005/0120467 A1* 6/2005 Desarmaux ..... A42B 3/16 2/422
2006/0064799 A1* 3/2006 Dion ..... A42B 3/326 2/424
2007/0124851 A1* 6/2007 Pyo ..... A42B 3/222 2/424
2007/0124852 A1* 6/2007 Pyo ..... A42B 3/326 2/424
2007/0136934 A1* 6/2007 Kim ..... A42B 3/222 2/424
2007/0226880 A1* 10/2007 Shida ..... A42B 3/326 2/410
2008/0115260 A1* 5/2008 Schulz ..... A42B 3/061 2/421
2008/0196148 A1* 8/2008 Morin ..... A42B 3/326 2/421
2009/0100576 A1* 4/2009 Kim ..... A42B 3/326 2/424
2010/0132095 A1 6/2010 Gafforio et al.
2011/0078846 A1* 4/2011 Gafforio ..... A42B 3/326 2/424
2011/0302701 A1* 12/2011 Kuo ..... A42B 3/326 2/421

FOREIGN PATENT DOCUMENTS

FR 2876882 A1 4/2006
GB 2175490 A * 12/1986 ..... A42B 3/06

* cited by examiner

HELMET WITH REMOVABLE CHIN GUARD

CROSS REFERENCE TO RELATED APPLICATIONS

This application is a National Phase filing under 35 U.S.C. §371 of PCT/EP2012/076649filed on Dec. 21, 2012; and this application claims priority to Application No. BG2011U000046 filed in Italy on Dec. 22, 2011 under 35 U.S.C. §119; the entire contents of all are hereby incorporated by reference.

The present invention relates to a protective helmet. In particular, the present invention relates to a protective helmet for motorcycle riders.

The helmet is a protective head covering made of a shock resistant material and used in play, sport and work. The main object of the helmet is to protect the head of the wearer from sudden impacts. In particular, this has the function of protecting the head from the effects of the impact of a body at speed against objects that are generally stationary, or vice versa.

The shape and the type of structure of the helmet enable it to achieve the desired protection to a greater or lesser degree, depending on different helmet types. These have at least two elements in common, i.e. the shell and the padding. The shell is the outer portion of the helmet, which is extremely strong as, in addition to redistributing the impact force over a vast area, it must remain as much as possible integral when stressed, as otherwise it would diminish, or even nullify, protection against possible lesions. The shell can be made of thermoplastic materials, such as ABS, polycarbonate, and the like, or with more costly but lighter compound materials, such as carbon, synthetic aramid fibers, or fiberglass. The padding is the shock absorbing portion of the helmet, usually made of styrene polymers, such as sintered expanded polystyrene (EPS) or the like, with the task of absorbing any impacts gradually, also dissipating at least part of the impact energy.

Different types of helmets are available, suitable for different purposes, or used, according to the preferences of the wearer, for the same purpose.

The "open" helmet, commonly called "jet", is produced with a shell that only partly surrounds the head and is provided with a visor of variable length, normally movable. This is mainly used by those riding small or medium powered motorcycles, especially in areas with warm climates and/or for urban use. In case of impact, it does not offer sufficient protection to the upper and lower jaw and to the nose, which are covered only by the visor, or may even be unprotected.

The "full-face" helmet, unlike the previous helmet, is produced using a shell that surrounds the whole head, including the neck, and is provided with a movable visor of small dimensions. This helmet is the device that offers the highest level of protection and is generally used by persons riding medium or high powered motorcycles and by those who use the motorcycle for medium or long journeys, above all in winter or in areas with a cold climate.

A further type of helmet is called "modular" or "flip-up" and combines the technical features of the two previously described helmets. It is produced, in the same way as full face helmets, with a single shell, surrounding the whole head, with a chin guard that can be moved for greater convenience and to expand the field of vision. In fact, the chin guard can be raised or flipped back, while remaining attached to the helmet.

The term chin guard is intended, in the present invention, as the portion of the helmet mainly intended for protecting the chin.

Numerous mechanisms are known for movement of the chin guard with respect to the helmet shell. In one embodiment, prior art helmets include an elastic movement system guided for example, by means of elastic hooks pivoted to the chin guard. By means of appropriate ties connected with these hooks and with a manual control lever, the wearer is able to vary the position of the chin guard from an operating position, for protecting the chin, to a separation position, in which the chin is unprotected, and vice versa.

The term operating position is intended, in the present invention, as the position in which the chin guard is integral and forms a continuous surface with the shell of the helmet.

The term separation position is intended, in the present invention, as the position in which the chin guard is detached, at least partly, from the shell of the helmet creating an opening at chin level.

Usually, this movement system does not provide any stable fastening of the chin guard when this latter is in the raised position. For this reason, prior art helmets according to the description must be used with the chin guard in the lowered position, to protect the face of the wearer, in order to obtain a helmet comparable with the full face helmet, thereby nullifying the effect of the opening.

Other prior art helmets allow the chin guard to be maintained in a raised position, so as to obtain a helmet comparable to a jet helmet. These are provided with a fastening mechanism that enables reversible locking of the chin guard, controllable by the wearer, both in raised and in lowered position. The reversible locking devices of the chin guard comprise means for the elastic movement, or rotation, thereof above the shell and means for locking the chin guard when this latter is in proximity of the end of travel of movement, or rotation. In normal conditions, this locking opposes rotation of the chin guard. If the wearer exerts sufficient pressure on the locking means to temporarily deform the elastic stop means, these enable release of the chin guard, ensuring resumption of the movement, or rotation, obtaining lowering thereof in protective position until reaching the opposite end of travel. In the absence of forces adapted for release, the chin guard is maintained in the end of travel position. Devices of this type produce mobility of the chin guard substantially on the basis of the greater or lesser resistance of elastically deformable elements, these latter being an integral part of the shell or solidly connected thereto, against a rigid element that is part of the chin guard, or vice versa.

Advantageously, the prior art helmets described above have a simple structure, but are nevertheless somewhat ineffective at maintaining the chin guard in raised position. This is due to the fact that an accidental force against the chin guard, even if moderate, is sufficient to release this latter from its raised position and cause unwanted lowering, or even breakage, of the same mechanism. As can be easily deduced by those skilled in the art, it is not possible to unduly stiffen the elastically deformable elements as, although this would prevent accidental forces exerted from causing accidental movement of the chin guard, when this latter is in the end of travel position it would be difficult for the wearer to overcome the resistance of the deformable elements.

Another disadvantage is the high wind drag of said prior art helmets when the chin guard is in raised position. This causes the "sail effect", which makes the motorcycle difficult to ride, causing upward movement of the helmet and, consequently, increasing the weight sustained by the body and the neck.

A further disadvantage of all the prior art embodiments consists in the high clearance of the chin guard with respect to the shell, due to the presence of mechanical components, above all elastic. In fact, over time and through continuous use, these tend to lose elastic memory, causing excessive clearance of the movable parts connected thereto.

It would therefore be desirable to obtain a helmet with movable chin guard which does not have the afore-mentioned problems of prior art.

It would also be desirable for this helmet to be easy for the wearer to use, requiring a few simple operations to modify the configuration.

It would also be desirable to obtain a helmet that is capable of minimizing, or even eliminating, the sail effect caused by air in movement when the chin guard is not arranged in operating position.

It would further be desirable to obtain a helmet wherein the chin guard can be repositioned manually, without the aid of equipment designed for this purpose.

Finally, it would be desirable to obtain a helmet with movable chin guard wherein the means for locking the latter to the helmet are subject to limited wear.

The present invention intends to minimize the above-mentioned drawbacks, eliminating the problems deriving from movement of the chin guard with respect to the shell of the helmet. An object of the present invention is, in fact, to provide a helmet wherein the chin guard is movable without the aid of appropriate mechanisms.

A further object of the present invention is to provide a helmet with chin guard that is movable so as to reduce, or even eliminate, the sail effect when the latter is not in operating position.

Yet another object of the present invention is to provide a helmet with chin guard that is movable rapidly and simply.

One more object of the present invention is to provide a helmet with movable chin guard capable of complying with the safety standards both when the chin guard is in operating position, and when it is in separation position.

Finally, an object of the present invention is to provide a helmet with movable chin guard wherein the locking means thereof are subject to limited wear caused by movement of the mechanical means of which they are formed.

In accordance with the invention, there is described a protective helmet comprising a chin guard removable from an operating position, for protecting the chin, characterized in that the shell of the helmet is provided with a portion for coupling with the chin guard when removed. In this way the helmet can be easily transformed into a helmet jet or, vice versa, into a full face helmet, according to the relative position of the chin guard.

Preferably, the coupling portion is produced in a different position from the protective position. Even more preferably, the coupling portion is produced in a position opposite the protective position.

In this way, there is substantially no modification to the aerodynamic resistance coefficient whether the chin guard is affixed in the coupling portion or not, thereby preventing the creation of bothersome turbulences and changes in the flow of air around the outer surface of the helmet. This arrangement also enables optimal balancing of the total weight of the helmet, without requiring noteworthy aesthetic variations.

Preferably, the coupling portion is produced in the back portion of the shell.

In this way, the sail effect created when the chin guard opposes the flow of air on the shell is limited to a minimum, or completely eliminated.

Preferably the coupling portion is shaped so as to at least partly comprise the chin guard.

Even more preferably, the coupling portion is shaped so as to fully comprise the chin guard.

This makes it possible to minimize the modifications imposed by the chin guard on the surface of the shell, also reducing changes in the flow of air on the helmet.

Preferably, the coupling portion is provided with first means for locking the chin guard in the coupling portion.

In this way, the first means enable the chin guard to be fastened integral with the shell of the helmet.

Even more preferably, the chin guard is provided with second means for locking it in the coupling portion and/or with said shell in operating position.

Therefore, the second means enable the chin guard to be positioned in operating position or in separation position.

Preferably, the first means and the second means are correspondent and produce locking of the chin guard in said coupling portion.

Correspondence between the two means enables easy and rapid disassembly and assembly of the chin guard to obtain correct positioning thereof in a fast and intuitive manner.

Further characteristics and advantages of the present invention will be more apparent from the description of a preferred, but not exclusive, embodiment of the present invention, illustrated by way of example in the accompanying figures, wherein.

Figure 1:
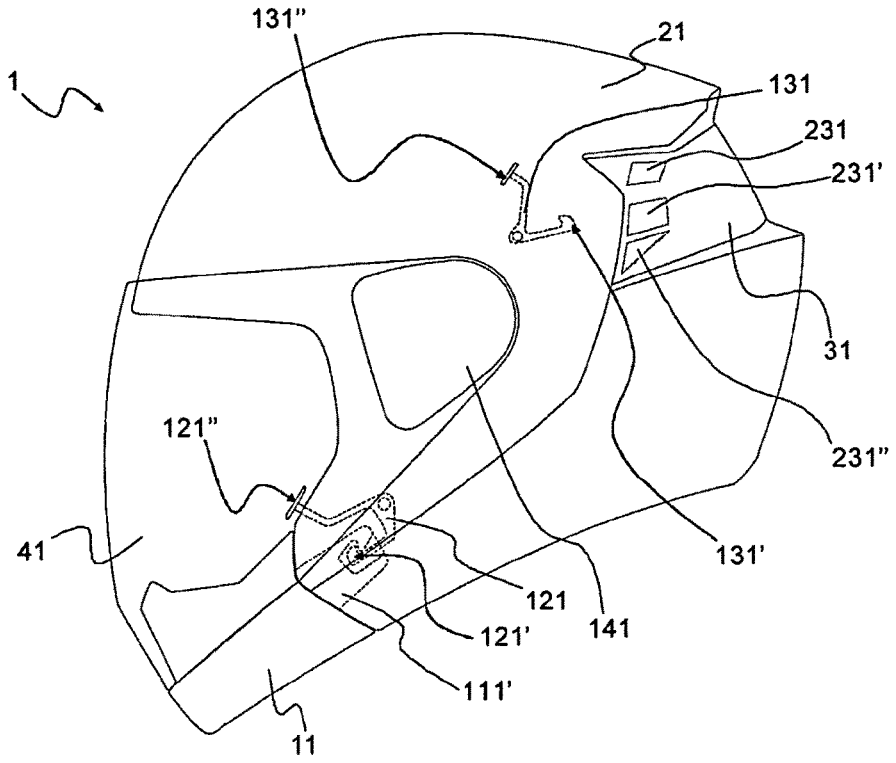
FIG. 1 is a perspective view of the helmet, according to the present invention, when the chin guard is in protective position.

With reference to FIG. 1, there is illustrated a protective helmet 1 for motorcycle use. This comprises a shell 21 preferably made of thermoplastic material produced so as to fully protect the head of the wearer. In particular, this shell 21 is provided, in the inner portion, with a padding (not illustrated) in sintered expanded polystyrene (EPS), or similar materials, to cushion any impacts to which the helmet may be subject.

In the front portion, level with the wearer's eyes, the helmet 1 comprises a visor 41 made of transparent thermoplastic material and connected integral with the shell 21 so as to be movable thereon by roto-translation. In particular, roto-translation is obtained through the pin means 141, which join the visor 41 to the shell 21.

In the back portion, level with the wearer's neck, the shell 21 has a portion 31 for coupling of the chin guard 11, described subsequently, when this latter is removed from the helmet 1. This portion 31 is shaped so as to fully comprise the chin guard 11, producing a continuous surface between the shell 21 and the same chin guard 11.

Alternatively, this coupling portion 31 could be shaped to comprise only a part of the chin guard 11, leaving the remaining part to project from the surface of the shell 21.

The coupling portion 31 is provided with first means 131 for locking the chin guard 11 therein. These comprised two hooks 131' in symmetrical position pivoted on the lateral walls of the portion 31 and each provided with a control lever 131" which can be operated manually from the inside of the padding of the shell 21. In particular, the first locking means 131 are provided with elastic means which retain the hooks 131' in raised position. The locking means could also be produced differently, without modifying the technical characteristics of the invention described herein.

The same first locking means are positioned symmetrically also in the front portion of the shell 21 at the operating position of the chin guard 11. In this case the hook 121' of the locking means 121 is facing outward, but is still positioned in the inner walls of the shell 21 in contact with the padding, with the same control levers 121" projecting outward.

In the same portion 31 there are produced slits 231, 231', 231" forming further ventilation holes. These also act as depressors to stabilize positioning of the helmet, preventing the sail effect.

The protective helmet 1 also comprises a chin guard 11 connectable to the shell 21, in operating position, and to the coupling portion 31 thereof, in separation position, through appropriate second locking means 111', 111". The chin guard 11 is generally made of the same materials used for the shell 21 and therefore has an outer surface in thermoplastic material and the inner portion thereof padded with EPS, or similar materials. The second means 111', 111" protrude from the ends thereof and have a profile adapted for insertion and locking of the hooks 121', 131'. Therefore, the first means 131, and consequently also the means 121, and the second means 111', 111" are correspondent and produce a geometric coupling which guarantees, respectively, locking of the chin guard 11 in the coupling portion 31 and with the shell 21 in operating position.

Let us assume that the wearer is wearing the helmet 1 in the embodiment as a full face helmet, as illustrated in FIG. 1, with the chin guard 11 positioned in operating position for protecting the chin. In this position, the locking means 121, placed in the front portion of the shell 21, retain the chin guard 11 producing geometric coupling between the hooks 121' of the same locking means 121 and the profile of the second locking means 111', 111" with which the chin guard 11 is provided. In particular, the hooks 121' retain the second means 111', 111" as a result of the elastic means with which they are provided.

Figure 2:
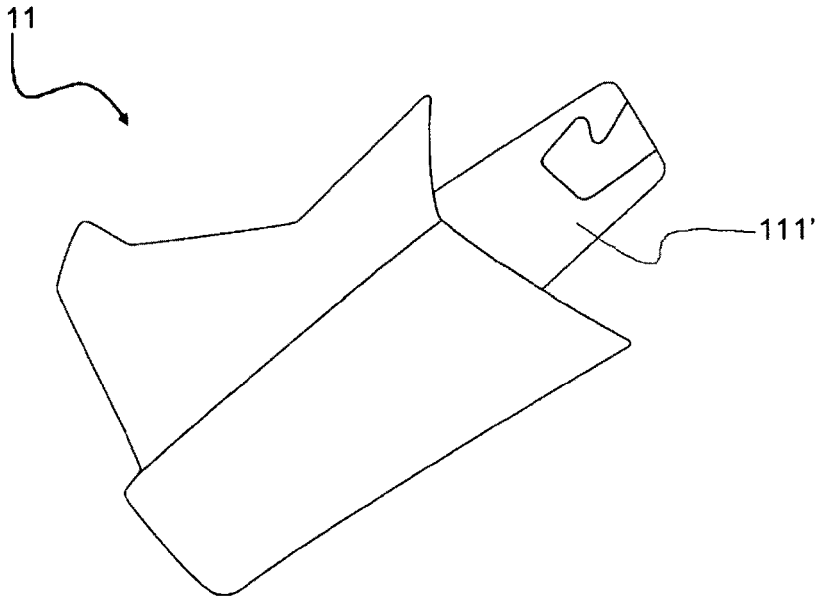
FIG. 2 is a perspective view of the chin guard of the helmet of FIG. 1 when detached therefrom, according to the present invention.

If the wearer wishes to transform the helmet from full face type to jet type, he/she detaches the chin guard 11 from the remaining portion of helmet 1. By operating the levers 121" manually, overcoming the resistance of the elastic means, the locking means 121 placed in the front portion of the shell 21 rotate, maintaining as rotation fulcrum the coupling point with the same shell 21. This rotation enables geometric decoupling between the hooks 121' and the profiles 111', 111" removing interconnection therebetween and releasing the chin guard 11. This latter is then removed simply by detaching it from the shell 21 disengaging the second means 111', 111" which act as guides for coupling with this latter. The removed chin guard 11 is illustrated in FIG. 2.

Figure 3:
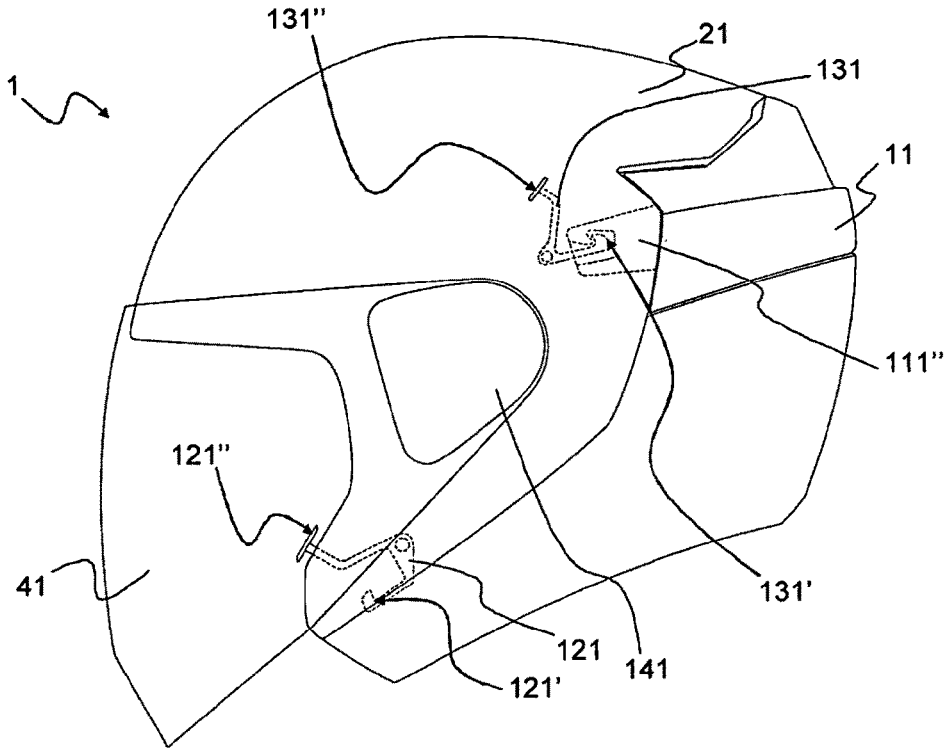
FIG. 3 is a perspective view of the helmet, according to the present invention, when the chin guard is in separation position inside the coupling portion.

To enable the chin guard 11 to be joined with the coupling portion 31 of the shell 21 it is rotated through 180° . To complete the jet type embodiment of the helmet 1, it is therefore necessary to insert the chin guard 11 in said portion 31. Also in this case, the second means 111', 111" act as guides and are engaged in the shell 21, coupling in a concealed manner with this latter. The portion 31 is shaped so as to completely contain the detached chin guard 11, producing a continuous surface between shell 21 and chin guard 11. Also in this case, the elastic means enable the first means 131 to maintain the position when the hooks 131' come into contact with the profiles of the second means 111', 111" coupling geometrically therewith. The embodiment of the helmet in jet mode is illustrated in FIG. 3.

With the chin guard 11 positioned in the portion 31 the sail effect, generated by wind drag on the helmet 1 during normal use, is eliminated as if said helmet 1 were effectively only a jet helmet.

Figure 4:
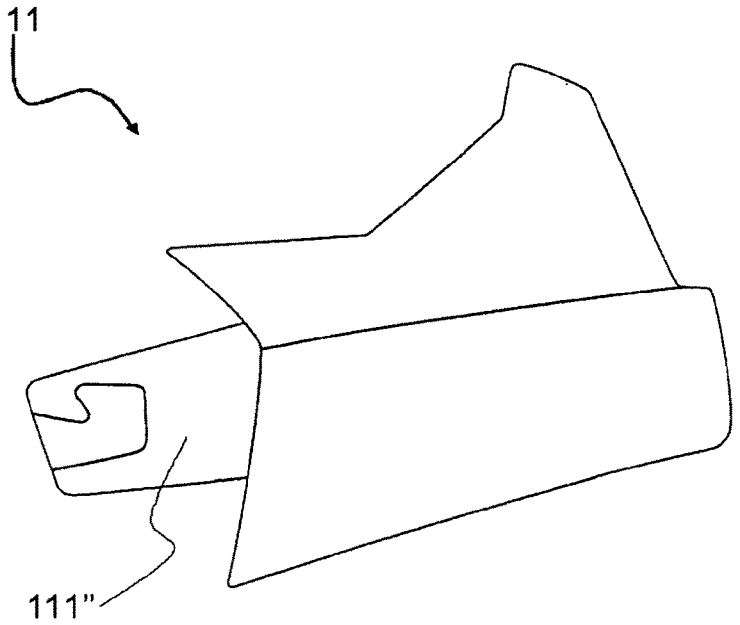
FIG. 4 is a perspective view of the chin guard of the helmet of FIG. 3 when detached therefrom, according to the present invention.

Moreover, if the wearer wishes to restore the full face type, he/she must detach the chin guard 11 from the portion 31, repositioning it on the front portion of the shell 21. In particular, detachment of the chin guard 11 is obtained using the control levers 131" of the first means 131, as described previously for detachment from the means 121. The chin guard 11 detached from the portion 31 is illustrated in FIG. 4.

To restore the full face helmet, as illustrated in FIG. 1, the chin guard 11 is inserted in the front portion of the shell 21 using as guides for said insertion the means 111', 111" of the same chin guard 11.

The technical solutions described enable the production of a protective helmet wherein the chin guard is movable from an operating position to a separation position, and vice versa. The chin guard is detachable so as to transform the helmet from full face type to jet type, and vice versa. In particular, affixing of the chin guard in a back portion of the shell of the helmet minimizes wind drag thereof, minimizing the sail effect.

The helmet according to the present invention is, moreover, capable of complying with the safety standards both with the chin guard in operating position and in separation position. In this way, it is possible to use the helmet without the chin guard also during movement.

The helmet according to the present invention is easy and inexpensive to produce, as it is formed by a limited number of components. Therefore, this ensures practical and easy assembly and disassembly even by those who are not skilled in the art, and considerable savings in terms of time for implementation and use.

Finally, the configuration and the positioning of the locking means enable the chin guard to be moved without inserting elements that are not integral with the shell or with the same chin guard, preventing these or parts thereof from projecting from the volume defined by the helmet.

The invention claimed is:

1. A protective helmet comprising:

a shell; and a chin guard removable from the shell, the chin guard having an operating position for protecting the chin, and a separated position for exposing the chin;

wherein the shell of said helmet is provided with a coupling portion adapted to support said chin guard when the chin guard is in the separated position;

wherein to switch from the operating position to the separated position, the chin guard must be disconnected from the shell and reattached to the shell at a different position on the shell.

2. The helmet according to claim 1, wherein when in the separated position the chin guard encircles a back portion of said shell.

3. The helmet according to claim 1, wherein said coupling portion is positioned in a different position from said operating position.

4. The helmet according to claim 3, wherein said coupling portion is positioned in a position opposite said operating position.

5. The helmet according to claim 1, wherein said coupling portion is shaped so as to at least partly house said chin guard.

6. The helmet according to claim 1, wherein said coupling portion is shaped so as to fully house said chin guard.

7. The helmet according to claim 1, wherein said coupling portion is provided with first means for locking and unlocking said chin guard in said coupling portion.

8. The helmet according to claim 7, wherein said chin guard is provided with second means for locking and unlocking said chin guard in said coupling portion and/or with said shell in operating position.

9. The helmet according to claim 8, wherein said first means and said second means are correspondent and produce locking and unlocking of said chin guard in said coupling portion.

10. The helmet according to claim 2, wherein said coupling portion is shaped so as to at least partly house said chin guard.

11. The helmet according to claim 3, wherein said coupling portion is shaped so as to at least partly house said chin guard.

12. The helmet according to claim 2, wherein said coupling portion is provided with first means for locking and unlocking said chin guard in said coupling portion.

13. The helmet according to claim 3, wherein said coupling portion is provided with first means for locking and unlocking said chin guard in said coupling portion.

14. The helmet according to claim 4, wherein said coupling portion is provided with first means for locking and unlocking said chin guard in said coupling portion.

15. The helmet according to claim 5, wherein said coupling portion is provided with first means for locking and unlocking said chin guard in said coupling portion.

16. The helmet according to claim 2, wherein said chin guard is provided with means for locking and unlocking said chin guard in said coupling portion and/or with said shell in operating position.

17. The helmet according to claim 3, wherein said chin guard is provided with means for locking and unlocking said chin guard in said coupling portion and/or with said shell in operating position.

18. A protective helmet switchable between a jet helmet configuration and a full helmet configuration, comprising:

a shell having a front side, lateral sides, and a back side;

a recess in the back side of the shell;

a chin guard selectively connectable to the shell;

the shell and the chin guard having at least two operating configurations, comprising:

a full helmet configuration in which the chin guard is connected to the lateral sides of the shell to protect a chin area;

a jet helmet configuration in which the chin guard is mounted in the recess in the back side of the shell.

19. The helmet of claim 18, wherein the helmet is switched from the full helmet configuration to the jet helmet configuration by disconnecting the chin guard from the lateral sides and mounting the chin guard in the recess.

20. The helmet of claim 18, wherein the recess is shaped so as to completely contain the chin guard when in the jet helmet configuration.

21. The helmet of claim 18, wherein when in the jet helmet configuration the chin guard and the shell form a continuous surface.

22. The helmet of claim 18, further comprising:

the chin guard including a first pair of hooks;

the shell including a second and third pair of hooks;

wherein in the full helmet configuration the first set of hooks engage the second pair of hooks;

wherein in the jet helmet configuration the first set of hooks engage the third pair of hooks.

* * * * *